US005643143A

United States Patent [19]

Burak et al.

[11] Patent Number: 5,643,143

[45] Date of Patent: Jul. 1, 1997

[54] WHEELCHAIR TRAINER

[75] Inventors: Jerome M. Burak, Chatsworth; Douglas Mayes, Los Angeles, both of Calif.

[73] Assignee: D&J Development Workshop, Inc., Van Nuys, Calif.

[21] Appl. No.: 594,126

[22] Filed: Jan. 31, 1996

[51] Int. Cl.[6] ..... A63B 22/02

[52] U.S. Cl. ..... 482/54; 482/904

[58] Field of Search ..... 482/54, 904, 61

[56] References Cited

U.S. PATENT DOCUMENTS

| | | | |
|---|---|---|---|
| 4,233,844 | 11/1980 | Dreisinger et al. . | |
| 4,441,705 | 4/1984 | Brown . | |
| 4,500,102 | 2/1985 | Haury et al. . | |
| 4,705,448 | 11/1987 | Mungons . | |
| 4,846,156 | 7/1989 | Kopnicky . | |
| 4,911,425 | 3/1990 | Kynast et al. . | |
| 4,966,362 | 10/1990 | Ramaekers . | |
| 5,163,885 | 11/1992 | Wanzer et al. . | |
| 5,197,558 | 3/1993 | Misawa . | |
| 5,333,894 | 8/1994 | Mayes . | |
| 5,383,830 | 1/1995 | Shu . | |
| 5,476,429 | 12/1995 | Bigelow et al. | 482/54 |

FOREIGN PATENT DOCUMENTS 2534806 4/1984 France .

OTHER PUBLICATIONS

Freeman, "Coach Extra Ordinaire", *Sports 'n Spokes* (Magazine), v. 20, n. 1, May/Jun. 1994, pp. 20–24.

Eagle Sportschairs, Pro–Roller Advertisement, *Sports 'n Spokes* (Magazine), v. 20, n. 1, May/Jun. 1994, p. 62.

D&J Development, Training Rollers Advertisement, *Sports 'n Spokes* (Magazine), v. 20, n. 1, May/Jun. 1994, p. 66.

McLain Cycle Products, "The Bug Roller" Advertisement, *Sports 'n Spokes* (Magazine), v. 20, n. 1, May/Jun. 1994, p. 86.

Racermate, Computrainer Operating Manual (1994).

*Primary Examiner*—Lynne A. Reichard
*Attorney, Agent, or Firm*—David Weiss

[57] ABSTRACT

Wheelchair trainer apparatus for use with a four-wheel everyday or sports wheelchair. The trainer includes a support plate carried by the trainer frame for holding the wheelchair front caster wheels in a position such that the wheelchair drive wheels drivably contact a roller with the center of each of the drive wheels directly vertically above the roller's rotational axis. In a preferred embodiment, the plate alternatively holds the wheelchair front caster wheels in a second position such that the wheelchair drive wheels drivably contact a second roller with the center of each of the drive wheels directly vertically above the second roller's rotational axis.

17 Claims, 3 Drawing Sheets

WHEELCHAIR TRAINER

BACKGROUND OF THE INVENTION

This invention relates to apparatus for the fitness and sports training of wheelchair users, and more particularly to four-wheel everyday and sports wheelchair support apparatus for permitting more effective workouts.

Wheelchairs are commonly used by physically disabled persons both for everyday transportation and for participating in sports activities such as basketball, tennis and road racing. The typical "everyday" wheelchair includes a frame to which two large rear wheels are rotatably mounted for being hand-driven by the user, one on each side of the frame for supporting the frame along with two small front pivotable wheels or casters, an example of which is shown in U.S. Pat. No. 4,966,362 to Ramaekers. The typical sports wheelchairs—also with two large drive wheels and two small front caster wheels—are generally stronger and more maneuverable than an everyday wheelchair; an example of such a sports wheelchair is shown in U.S. Pat. No. 4,500,102 to Haury et al. Another type of wheelchair, known as a "racer" wheelchair and used for competition racing, has three wheels—two large rear drive wheels and a single non-caster front wheel somewhat smaller than the rear wheels, such as shown in U.S. Pat. No. 5,333,894 to Mayes. Each of the afore-mentioned U.S. Patents are incorporated herein by herein by reference.

Physiological training of the wheelchair user, whether for rehabilitation, fitness, or proficiency in one or more sports, has been implemented in the past by various exerciser or trainer devices. In one such exerciser, disclosed in Ramekers U.S. Pat. No. 4,966,362, a pair of rollers are rotatably mounted in a frame with their rotational axes parallel to each other and spaced to cradle the wheelchair's drive wheels. The wheelchair is backwardly driven up a ramp and the rear wheels are rolled into the roller cradle with the front caster wheels resting on the ramp. The wheelchair user drives the drive wheels of the stationary wheelchair, and the drive wheels drive the rollers in which the wheels are cradled.

It has been experienced that the contact of the rubber tires at the periphery of the wheelchair's drive wheels, when drivably cradled between the two rollers, produces undesired drag, "scrubbing" the rubber from the tires while often providing an audible squeal. Such undesired drag imparts increased resistance to drive wheel rotation, to the extent that a user with little hand strength may be unable to effectively drive the drive wheels when engaged with the rollers. These phenomena are thought to be caused by the circumstance that the wheelchair's drive wheels are generally set closer together at the top than at the bottom, a condition referred to as "camber". Scrubbing may be further increased if the rear drive wheels are additionally set so that they are closer together at the front than at the back (or closer together at the back than at the front), a condition known as "toe".

Trainers for three-wheel racer wheelchairs are known where scrubbing is substantially reduced. One such trainer includes a single roller for being driven by the racer wheelchair's two drive wheels, with the front wheel supported in place such that the center of each of the drive wheels are directly vertically above the roller rotational axis. Another such prior art trainer, developed by the present inventors, utilizes two rollers of different diameters with their rotational axes parallel to one another and with the crest of each roller in the same horizontal plane. When used with a racer wheelchair, the wheelchair is positioned such that its front wheel is supported in place such that the centers of its drive wheels are directly vertically above one or the other of the roller axes for driving the roller which is contacted by the drive wheels. When used with a four-wheel everyday wheelchair or sports wheelchair, however, the wheelchair's drive wheels are cradled between the two rollers with the front caster wheels resting on the ramp. The compact configuration of four-wheel everyday and sports wheelchairs has, in the past, precluded the realization of trainer apparatus for supporting such wheelchairs with the centers of their drive wheels directly vertically above the longitudinal axis of one roller for driving that roller.

SUMMARY OF THE INVENTION

The wheelchair trainer of the present invention provides a support for holding the front caster wheels of a four-wheel everyday wheelchair or sports wheelchair such that the wheelchair's drive wheels contact a roller for rotatably driving the roller with the center of each of the drive wheels directly vertically above the longitudinal axis of the roller, effectively minimizing scrubbing or undesired drag caused by camber and toe of the wheelchair's drive wheels. In a preferred trainer embodiment, the support holds the wheelchair front caster wheels such that the rear drive wheels drivably contact a selected one of two trainer rollers with the centers of the drive wheels directly vertically above the longitudinal axis of the selected roller.

Briefly described, the present invention provides a wheelchair trainer apparatus, comprising the combination of: a wheelchair having two rear drive wheels and two front caster wheels; a trainer frame; a roller having a longitudinal axis and mounted to the frame for being rotatably driven about the roller axis; and a support carried by the frame for holding the wheelchair front caster wheels in a position such that the wheelchair drive wheels drivably contact the roller with the center of each of the drive wheels directly vertically above the roller axis. The support includes a plate having a trough parallel to the roller axis for captively receiving the wheelchair front caster wheels in such position.

In a preferred embodiment according to the present invention, a trainer apparatus is provided for use with a wheelchair having two rear drive wheels and two front caster wheels, comprising the combination of: a frame; a first roller having a longitudinal axis and mounted to the frame for being rotatably driven about the first roller axis; a second roller having a longitudinal axis and mounted to the frame for being rotatably driven about the second roller axis and with the axes of the rollers parallel to one another and horizontally spaced apart by a predetermined distance; and a support carried by the frame for holding the wheelchair front caster wheels in a first position such that the wheelchair drive wheels contact the first roller for rotatably driving the first roller with the center of each of the drive wheels directly vertically above the first roller axis, and alternatively for holding the wheelchair front caster wheels in a second position such that the wheelchair drive wheels contact the second roller for rotatably driving the second roller with the center of each of the drive wheels directly vertically above the second roller axis. A ramp is provided for accessing the wheelchair to the frame such that the wheelchair front caster wheels are held by the support in these positions. The trainer may include a load generator coupled to the first roller, for applying rotational resistance to the first roller, and a control module for controlling the load generator.

The support is horizontally adjustable with respect to the frame perpendicularly to the roller axis for adjusting the position of the support for holding the wheelchair front caster wheels in the first position and alternatively, without further adjustment of the support, for holding the wheelchair first wheels in the second position. The support includes a plate having a first trough parallel to the roller axis for captively receiving the wheelchair front caster wheels in the first position and a second trough parallel to the roller axes and spaced from the first trough by the predetermined distance of which the roller axes are horizontally spaced apart for captively receiving the wheelchair front caster wheels in the second position.

The trainer's frame includes a rail extending horizontally perpendicular to the roller axes, and the support plate is positionally adjustable along the rail for adjusting position of the first trough for holding the wheelchair front wheels in the first position. The first roller is heavier and is of greater diameter than the second roller, with the crests of the rollers being in the same horizontal plane, and the plate is carried by the frame such that the bottoms of the wheelchair's front wheels are in such horizontal plane when the wheelchair's front wheels are received by either of the troughs.

The trainer may include a load generator coupled to the first roller for applying rotational resistance thereto, and a control module for controlling the load generator.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
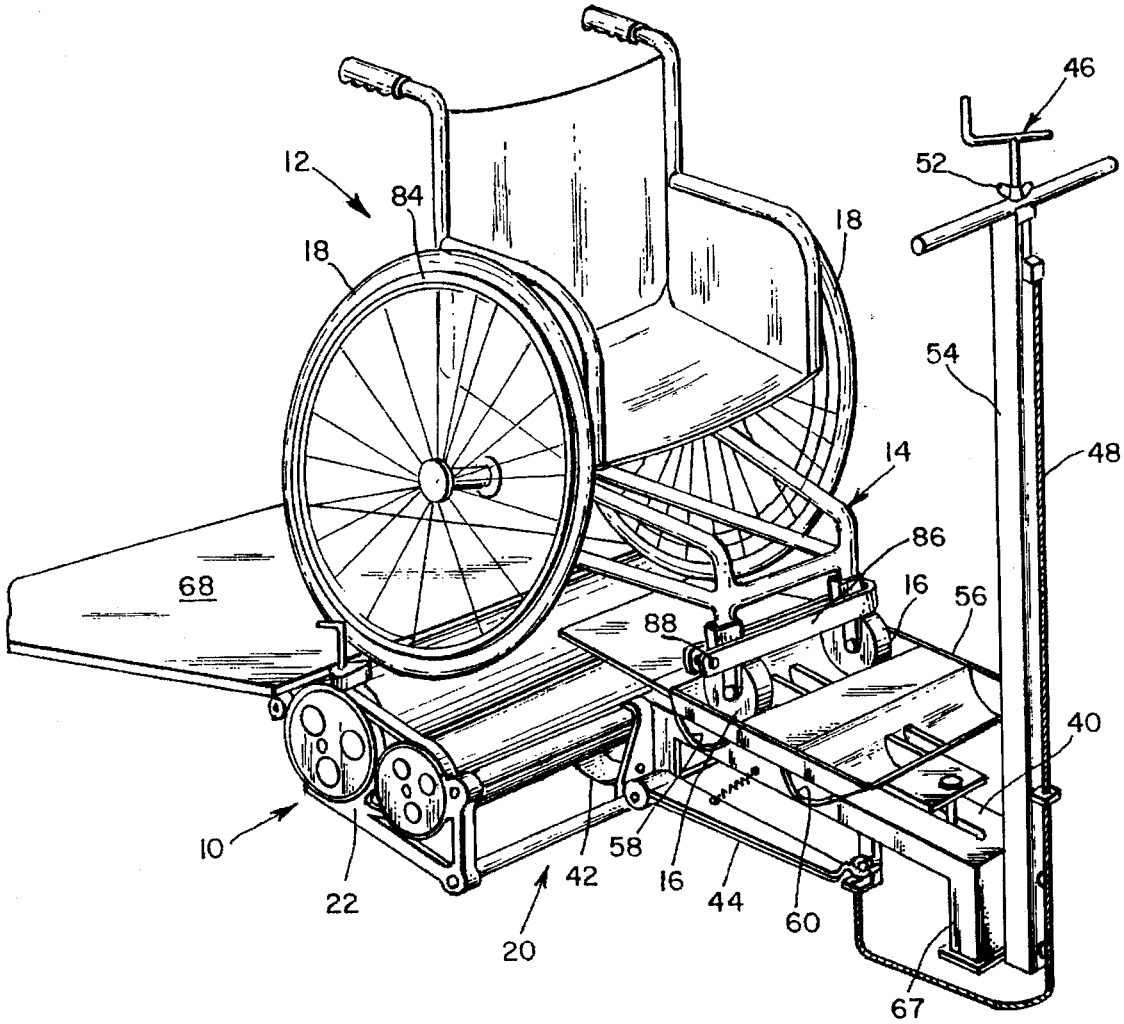
FIG. 1 is a front side perspective view of a preferred embodiment of the wheelchair trainer according to the present invention, shown with a four-wheel everyday or sports wheelchair in place thereon.
Figures 3, 4:
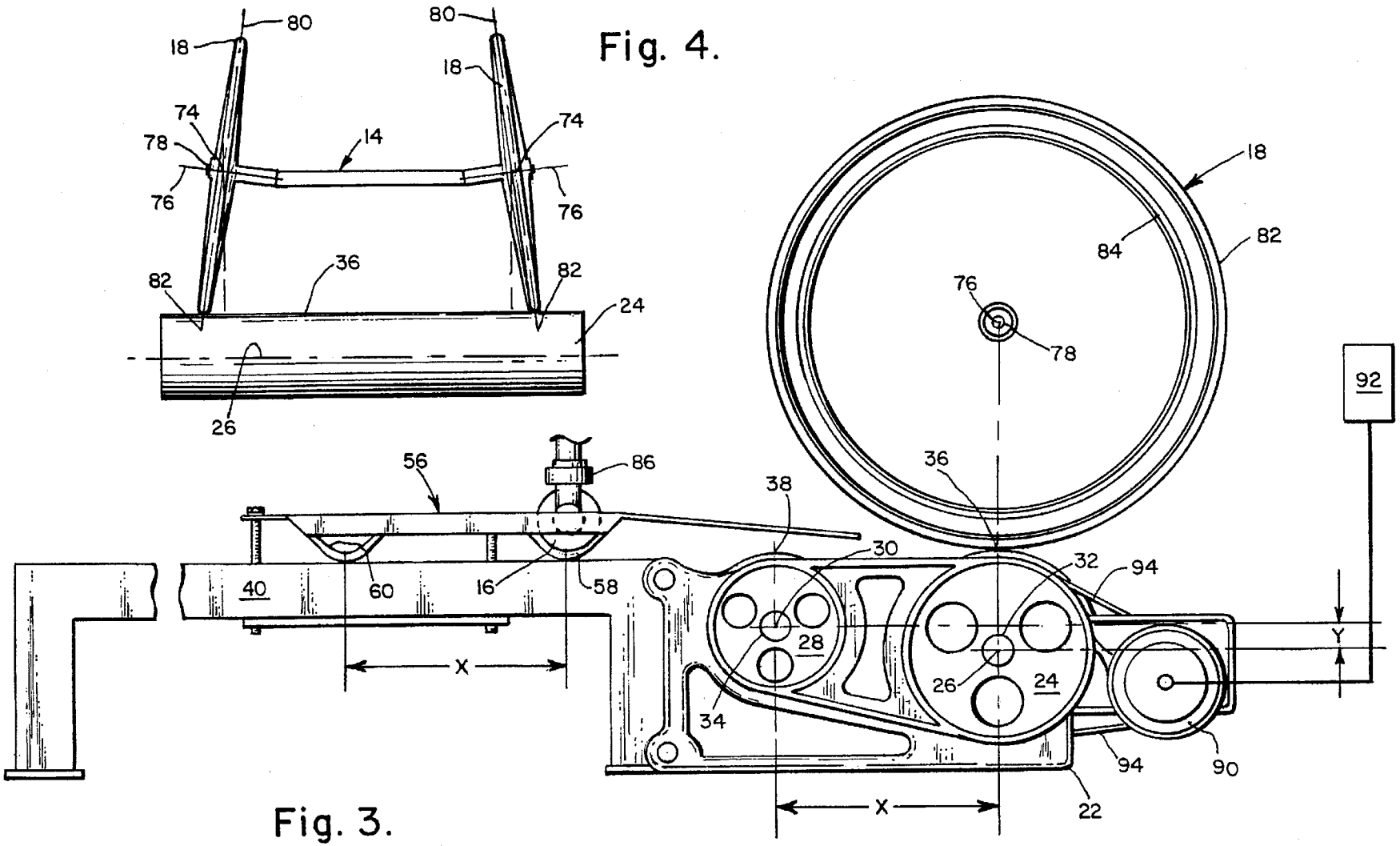
FIG. 3 is a partial side elevation view of the trainer of FIG. 1, shown with the front and rear wheels of the wheelchair in place.
FIG. 4 is a partial rear elevation view of the apparatus of FIG. 3.

Turning first to FIG. 1, there is shown a preferred embodiment of wheelchair trainer apparatus 10 for use with a four-wheel everyday or sports wheelchair 12 such as an everyday wheelchair as shown in U.S. Pat. No. 4,966,362 to Ramaekers or the four-wheel wheelchair as shown in U.S. Pat. No. 4,500,102 to Haury et al. (both of which patents are incorporated herein by reference). The wheelchair 12 includes a structural frame 14, two small caster wheels 16 pivotally mounted to the front of the wheelchair frame 14, and two large drive wheels 18 mounted to the rear of the wheelchair frame 14 and on either side thereof such that they exhibit a preselected camber as shown in FIG. 4 and may further exhibit a preselected toe.

Figure 2:
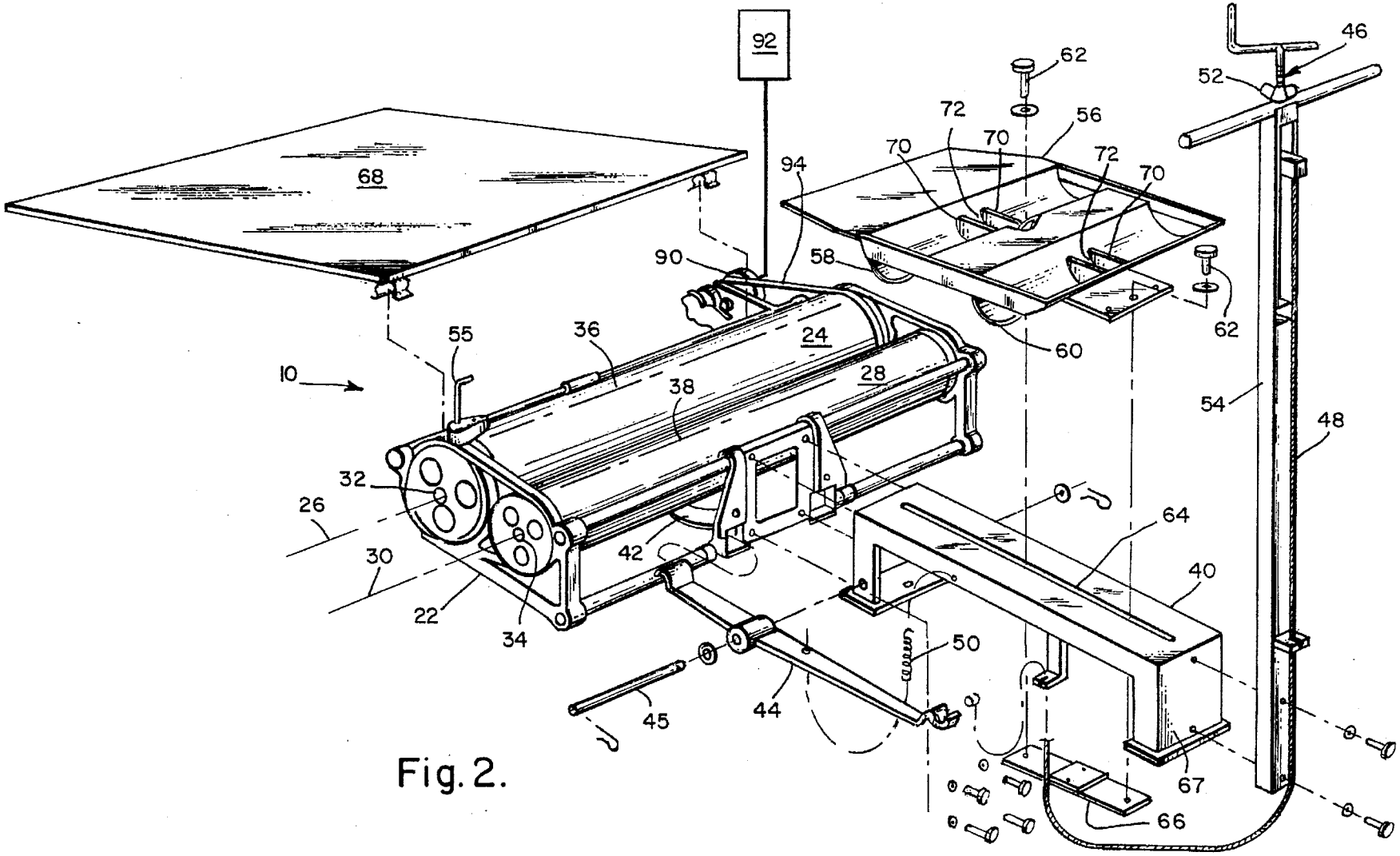
FIG. 2 is an exploded view of the trainer of FIG. 1.

Considering FIG. 2 along with FIG. 1, the trainer 10 includes a frame 20 including a subframe or roller mount 22. A first roller 24 having a longitudinal axis 26 and a second roller 28 having a longitudinal axis 30 are mounted to the roller mount 22 for rotation about their respective axes 26, 30. The rollers 24, 28 may be constructed of steel with aluminum end caps and with axles 32, 34 respectively along their longitudinal axes 26, 30 and rotatably mounted to the frame roller mount 22 by conventional means such as bearings. The first roller 24 is heavier and of a larger diameter than the second roller 28; the heavier roller 24 may be used for simulating road work and the lighter roller 28 may be used to work on hand speed and cardiovascular conditioning. In one example of such rollers, the outside diameters of the first and second rollers 24, 28 were 6⅝ inches and 5 inches, respectively. The roller axes 26, 30 are parallel to each other and (as best shown in FIG. 3) are horizontallly spaced apart by a predetermined distance x. The roller axes 26, 30 are vertically spaced apart by a distance y (FIG. 3) such that the crests of 36, 38 (FIGS. 2 and 3) of both rollers (i.e. the upper horizontal tangents to the circumferences of the rollers 24, 28) lie in substantially the same or a common horizontal plane.

The trainer frame 20 further includes a rail 40 secured to the roller mount 22, approximately centered between the ends of the rollers 24, 28 and extending horizontally perpendicular to the roller axes 26, 30. Resistance against rotation may be applied to the rollers 24, 28 by a friction band 42 for bearing against the surface of the rollers 24, 28 in response to the pivotal position of a brake arm 44 (pivotable about shaft 45 secured to the rail 40) controlled by a manually operable brake adjuster 46 through an adjuster cable 48 operating against spring 50. The manual brake adjuster 46 and its wing nut 52 for locking down the brake adjuster 46, are located at the upper end of a vertical bar 54 secured to the rail 40, within easy reach of the wheelchair user when the wheelchair 12 is in place on the trainer 10 so that the amount of resistance applied to the rollers 24, 28 may be controlled by the user. The brake adjuster 46 may also be used for braking the rollers 24, 28, for permitting the wheelchair user to place the wheelchair's drive wheels 18 in contact with, and to exit from, either of the rollers 24, 28. It may be noted that the user may also lock the first roller 24 against rotation by means of the roller lock pin 55.

A support plate 56, with two troughs 58, 60 set therein parallel to the roller longitudinal axes 26, 30, is carried by the rail 40 and adjustably secured therealong, such as by bolts 62 extending through the plate 56 and a slot 64 along the rail 40 and threadably secured to a locking bar 66. The dimensions of the troughs 58, 60 are such that the wheelchair's two front caster wheels 16 may be accommodated in one or the other of the troughs 58, 60 for being captured therein. The rail 40 includes legs 67, which are preferably of a height for maintaining the wheelchair 12 in a substantially horizontal position when the wheelchair 12 is positioned in the trainer 10 for driving either of the rollers 24, 28, i.e. the bottoms of the front wheels 16 are in the same horizontal plane as the crests 36, 38 of the first and second rollers 24, 28. An inclined plate or ramp 68 is secured to the roller mount 22 and, in use, the wheelchair 12 is forwardly driven up the ramp 68, permitting the wheelchair 12 access to the rollers 24, 28 and the front caster wheels 16 to the rail-supported plate 56. Each of the troughs may include upstanding partition members or walls 70 thereacross, forming a central channel 72 therebetween for captively receiving a single caster wheel of a type of sports wheelchair having only a single front caster wheel.

The centerlines along the troughs 58, 60 are spaced from each other by the same predetermined distance x horizontally separating the longitudinal axes 26, 30 of the two rollers 24, 28, as noted in FIG. 3. The support plate 56 may be positionally adjusted for being fixedly secured along the rail 40 such that the first trough 58 will captively receive and support the wheelchair's two front caster wheels 16 when the wheelchair 12 is positioned on the trainer 10 with the drive wheel centers 74 directly vertically above the longitudinal axis 26 of the roller 24. Specifically, the center 74 of each drive wheel 18 is located at the intersection of the rotational axis 76 of the wheel's axle 78 and the wheel's diameter 80, and the wheelchair 12 is positioned with the wheel centers 74 directly vertically above the axle 32 of the roller 24 so that the tire 82 of each of the drive wheels 18 contacts the crest 36 of the roller 24. In a usual circumstance where the wheels 18 exhibit camber (as shown in FIG. 4), and perhaps no toe, the rotational axis of each of the drive wheels 18 is aligned directly above the rotational axis 26 of the roller 24, i.e. the drive wheel axes and the roller axis 26 are in the same of a common vertical plane. Accordingly, the wheelchair 12 may be positioned with the drive wheels' tires 82 engaging the roller 24 with the end of each drive wheel axis 78 vertically directly above the end of the roller axle 32 as shown in FIG. 3.

For a particular wheelchair 12, the support plate 56 is positionally adjusted and locked along the rail 40 such that the wheelchair's drive wheels 18 are correctly positioned on the first roller 24 (i.e. with the drive wheels' centers 74 directly vertically above the longitudinal axis 26 of the first roller 24, with the tires 76 drivably contacting the crest 36 of the first roller 24) when the wheelchair's front caster wheels 16 are captively received by the support plate's first trough 58. Since the longitudinal centerlines of the troughs 58, 60 are horizontally separated by the same predetermined distance x as the horizontal separation between the longitudinal axes 26, 30 of the rollers 24, 28, without further adjustment of the support plate 56 the drive wheels 18 of the wheelchair 12 will be correctly positioned on the second roller 28 (i.e. with the drive wheels' centers 74 directly vertically above the longitudinal axis 30 of the second roller 28, with the tires 82 drivably contacting the crest 38 of the second roller 28) when the two front caster wheels 16 of the wheelchair 12 are captively received by the second trough 60. As shown in FIG. 1, the two front caster wheels 16 may be locked against pivotal movement while in a trough 58, 60, for example by a U-shaped front wheel lock 86 secured at its ends by a quick release locking pin 88.

It may be appreciated that the width of the plate 56 (i.e. the dimension parallel to the roller axes 28, 30) is less than the distance separating the two drive wheels 18—at least where the plate 56 extends over either of the rollers 24, 28—so as not to preclude contact between the wheels 18 and either of the rollers 24, 28. The support plate 56 and rail 40 may be fabricated of 3/16 inch cold rolled steel for strength and rigidity. In one example, the width of the plate 56 was approximately 18.5 inches along the troughs 58, 60, and the distance x was approximately 8 inches. The width and length of the rail 40 were approximately 6 inches and 25 inches, respectively, and the distance between the crest 36 of the first roller 24 and the forward end of the rail 40 was approximately 36.5 inches. The width across the open top of the first trough 58 was approximately 4 5/16 inches, and the depth of the first trough 58 was approximately 1 5/8 inches; the width across the open top of the second trough 60 was approximately 5 1/4 inches, and the depth of the second trough 60 was approximately 2 inches.

The wheelchair trainer 10 may further include a load generator 90 for applying resistance against rotation to the first roller 24, with the amount of load or resistance controlled by a microprocessor-based control module 92 which may be hand held or mounted to the wheelchair 12 or to the trainer 10 in a location convenient to the wheelchair user. The resulting physiological monitoring capability allows the trainer 10 to be used for testing fitness and monitoring progress toward the user's specific performance goals. In one application, the user may set the control module 92 at a desired work load level, for operating the trainer 10 as a wheelchair ergometer. In one example, the load generator 90 was an eddy current brake (such as distributed by RacerMate, of Seattle, Wash., under the designation R-983-006-00) driven by the first roller 24 through a drive belt 94. The control module 92 may be of a type such as distributed by RacerMate, of Seattle, Wash., under the designation R-983-009-00, and used by RacerMate in its CompuTrainer computer aided bicycle trainer Model 8000.

Thus there has been shown a wheelchair trainer apparatus for use with a four-wheel everyday or sports wheelchair. The preferred trainer embodiment includes a support plate for holding the wheelchair front caster wheels in a first position such that the wheelchair drive wheels drivably contact a first roller with the center of each of the wheelchair drive wheels directly vertically above the rotational axis of the first roller, and alternatively for holding the wheelchair front caster wheels in a second position such that the wheelchair drive wheels drivably contact a second roller with the center of each of the drive wheels directly vertically above the rotational axis of the second roller. Other embodiments of the present invention and modifications of the embodiment herein presented may be developed without departing from the essential characteristics thereof. Accordingly, the invention should be limited only by the scope of the claims listed below.

We claim:

1. Wheelchair trainer apparatus, comprising the combination of:

a wheelchair having two rear drive wheels and two front caster wheels;

a frame;

a first roller having a longitudinal axis and mounted to said frame for being rotatably driven about said axis of said first roller;

a second roller having a longitudinal axis and mounted to said frame for being rotatably driven about said axis of said second roller and with said axes of said rollers parallel to one another and horizontally spaced apart by a predetermined distance; and a support secured to said frame including a first trough parallel to said axes for receiving said wheelchair front caster wheels in a first position such that said wheelchair drive wheels contact said first roller for rotatably driving said first roller with the center of each of said drive wheels directly vertically above said axis of said first roller, said support further including a second trough parallel to said first trough and horizontally spaced therefrom by said predetermined distance for alternatively receiving said wheelchair front caster wheels in a second position such that said wheelchair drive wheels contact said second roller for rotatably driving said second roller with the center of each of said drive wheels directly vertically above said axis of said second roller.

2. The apparatus according to claim 1, further including:

a ramp secured to said frame for forwardly accessing said wheelchair to said frame such that said wheelchair front caster wheels are alternatively received by said troughs in said positions.

3. The apparatus according to claim 1, further including:

a load generator coupled to said first roller for applying rotational resistance to said first roller; and a control module for controlling said load generator.

4. The apparatus according to claim 1, wherein:

said support is horizontally adjustable with respect to said frame perpendicularly to said axes, for adjusting position of said first trough and said second trough for receiving said wheelchair front caster wheels in said first position and alternatively in said second position.

5. The apparatus according to claim 1, further including:

means for locking said wheelchair two front caster wheels to prevent pivoting thereof when received by one of said troughs.

6. The apparatus according to claim 1, wherein:

said frame includes a rail extending horizontally perpendicular to said axes, and said support is adjustably securable along said rail for adjusting position of said first trough for receiving said wheelchair front caster wheels in said first position and alternatively for receiving said wheelchair front caster wheels in said second position without further adjustment of said support.

7. The apparatus according to claim 6, wherein:

said first roller is heavier than said second roller.

8. The apparatus according to claim 6, wherein:

the diameter of said first roller is greater than the diameter of said second roller, and the crests of said rollers are in the same horizontal plane.

9. The apparatus according to claim 8, wherein:

said support is carried by said frame such that the bottoms of said wheelchair front caster wheels are in said horizontal plane when said wheelchair front caster wheels are received by either of said troughs.

10. The apparatus according to claim 9, further including:

a load generator coupled to said first roller for applying rotational resistance thereto; and a control module for controlling said load generator.

11. Wheelchair trainer apparatus, comprising the combination of:

a wheelchair having two rear drive wheels and two front caster wheels;

a trainer frame;

a roller having a longitudinal axis and mounted to said frame for being rotatably driven about said axis;

a ramp secured to said frame for forwardly accessing said wheelchair up said ramp and to said frame; and a support secured to said frame for captively receiving said wheelchair front caster wheels in a position when said wheelchair is forwardly accessed to said frame such that said wheelchair drive wheels drivably contact said roller with the center of each of said drive wheels directly vertically above said axis.

12. The apparatus according to claim 11, further including:

a load generator coupled to said roller for applying rotational resistance thereto; and a control module for controlling said load generator.

13. The apparatus according to claim 11, wherein:

said support includes a plate having a trough parallel to said axis for captively receiving said wheelchair front caster wheels in said position.

14. The apparatus according to claim 13, further including:

means for locking said wheelchair two front caster wheels to prevent pivoting thereof when received by said trough.

15. The apparatus according to claim 13, wherein:

said frame includes a rail extending horizontally perpendicular to said axis, and said plate is adjustably securable along said rail for adjusting position of said trough for captively receiving said wheelchair front caster wheels in said position.

16. The apparatus according to claim 15, wherein:

said plate is secured to by said frame such that the bottoms of said wheelchair front caster wheels and the crest of said roller are in the same horizontal plane when said wheelchair front caster wheels are received by said trough.

17. The apparatus according to claim 16, further including:

a load generator coupled to said roller for applying rotational resistance thereto; and a control module for controlling said load generator.

* * * * *